US008953831B2

(12) United States Patent
Jankovsky et al.

(10) Patent No.: US 8,953,831 B2
(45) Date of Patent: Feb. 10, 2015

(54) NARROW MOUTH HORN LOUDSPEAKER

(71) Applicant: Bose Corporation, Framingham, MA (US)

(72) Inventors: Joseph Jankovsky, Holliston, MA (US); Sarah M. Heile, Marlborough, MA (US); John H. Wendell, Boston, MA (US)

(73) Assignee: Bose Corporation, Framingham, MA (US)

( * ) Notice: Subject to any disclaimer, the term of this patent is extended or adjusted under 35 U.S.C. 154(b) by 21 days.

(21) Appl. No.: 13/630,305

(22) Filed: Sep. 28, 2012

(65) Prior Publication Data

US 2014/0093111 A1 Apr. 3, 2014

(51) Int. Cl.

| | |
|---|---|
| ***H04R 25/00*** | (2006.01) |
| ***H04R 1/30*** | (2006.01) |
| ***H04R 1/28*** | (2006.01) |
| ***G10K 11/02*** | (2006.01) |
| ***H04R 1/34*** | (2006.01) |

(52) U.S. Cl.

CPC ..... *H04R 1/30* (2013.01); *H04R 1/2865* (2013.01); *G10K 11/025* (2013.01); *H04R 1/345* (2013.01)

USPC ..... 381/340; 381/337; 381/339; 181/192

(58) Field of Classification Search

CPC ..... H04R 1/30; H04R 1/345; H04R 1/2865; H04R 1/2861; G10K 11/025; G10K 11/02; G10K 11/26

USPC ..... 381/337, 339, 340, 341, 342; 181/152, 181/159, 177, 184, 185, 187, 192, 195, 199

See application file for complete search history.

(56) References Cited

U.S. PATENT DOCUMENTS

| | | | | |
|---|---|---|---|---|
| 1,840,992 A | | 1/1932 | Weitling | |
| 3,174,578 A | | 3/1965 | Kojima | |
| 3,944,757 A | | 3/1976 | Tsukamoto | |
| 4,171,734 A | * | 10/1979 | Peveto et al. | 181/192 |
| 4,706,295 A | | 11/1987 | Putnam et al. | |
| 5,109,422 A | | 4/1992 | Furukawa | |
| 5,261,006 A | | 11/1993 | Nieuwendijk et al. | |
| 5,792,000 A | | 8/1998 | Weber et al. | |

FOREIGN PATENT DOCUMENTS

| | | |
|---|---|---|
| FR | 844769 A | 8/1939 |
| GB | 22965 | 0/1908 |
| GB | 310493 A | 1/1930 |
| GB | 1159613 A | 7/1969 |
| JP | 55165097 A | 12/1980 |

* cited by examiner

*Primary Examiner* — Huyen D Le
(74) *Attorney, Agent, or Firm* — Bose Corporation

(57) ABSTRACT

An acoustic horn. In one implementation, the horn includes at least four wall sections, defining a passageway. The cross-sectional area of the mouth is at least ten times the cross sectional area of the throat. The wall sections are dimensioned so that at least one wall section has a dimension at the throat at least ten times a dimension at the throat of a second wall section. In another implementation the cross-section at the mouth is elongated and is be bounded by a continuous curve defining a geometric figure having a major axis at least ten times a minor axis.

17 Claims, 7 Drawing Sheets

NARROW MOUTH HORN LOUDSPEAKER

BACKGROUND

This specification relates to horn type loudspeakers. Horns are structures that affect the directional characteristics of acoustic energy that is radiated into the horn by an acoustic driver. Typically, the horn causes the acoustic energy to be radiated in a directional pattern, which will be discussed later. Horns typically include a throat, into which acoustic energy is radiated, and a mouth, from which acoustic energy is radiated to the environment. It is desirable that the impedance of the horn at the mouth match the impedance of the free air. If there is an impedance mismatch, some of the acoustic energy may be reflected back into the horn which creates audible resonances. One technique used to dampen the resonances is to create resistive leaks in the horn walls.

For example, FIG. 1 of U.S. Pat. No. 3,174,578 (hereinafter '578) is reproduced as FIG. 1 of the attached drawings. According to '578, the horn 1 of FIG. 1 has innumerable pores or slits in the wall 2, which pores are arranged near the mouth portion as described hereinafter. Air is allowed to leak through the pores or slits and is damped by acoustical resistance 3 such as silk cloth or wire gauze stretched over the pores or slits.

Further according to '578, the sound wave travelling from the horn throat 4 is initially a plane wave 5 and gradually changes to a spherical wave 6 as it passes the region where the wall has pores or slits. The change in shape of the sound wave results from the fact that the horn tends to have the character of the open end of an acoustical tube at the portion of the horn having pores owing to the leakage through the wall and the wave at the open end assumes the form of spherical wave as is well known.

Still further according to '578, upon reaching the horn mouth 7 the sound wave surface can take the form of a sphere 8 whose radius is almost equal to that of the horn mouth if suitable leakage through the wall is allowed. If the radius of the sound wave at 8 is equal to the radius of the horn mouth 7, the sound wave does not reflect at the horn mouth and the output sound pressure of the horn has no peak nor [sic or] dip at varying frequencies.

Another example is described in U.K. Pat. 22,965, of which FIG. 1 is reproduced as FIG. 2. According to U.K. Pat. 22,965, FIG. 2 shews [sic] the base of a trumpet. This base is perforated with holes of various diameters arranged parallel with the rim• of the trumpet and distributed uniformly over the base. Without entering into the theory of these perforations, it can nevertheless be stated that good results are obtained by arranging the holes along the generating lines of the trumpet, by diminishing the diameter of the holes as they recede from the base, by making the diameter of the holes in the first row proportionate to the diameter of the trumpet, and by stopping the perforations at a certain distance from the base.

Still another example is described in U.S. Pat. No. 1,840,992 (hereinafter '992), of which FIG. 1 is reproduced below as FIG. 3. According to U.S. Pat. No. '992, carrying out [the] invention, the horn is made of a body 5 which may be made of any suitable material of sufficient stiffness to maintain the horn in its proper shape. [The inventor] contemplate[s] the use of thin perforate metal, papier-mache, wire mesh, wood, wicker, bamboo, or any other material suitable for the purpose. The stiff material 5 forming the body of the horn is preferably provided throughout its entire surface with a series of perforations 6. Any foraminous material such as a skeleton frame work of strip material with spaces between will suffice.

These perforations can be very closely spaced; they may vary in shape and size; they may be situated in various areas of the horn and they may be in the form or slits, slots or various shaped openings. These perforations may be placed throughout the area of the horn or they may be localized to suit different requirements of sound distribution. It is also entirely feasible to use one or more large openings in place of a series of small openings, if desired.

Further according to '992, to dampen out undesirable resonance in the horn, [The inventor] find[s] it desirable to line both inner and outer faces of the horn with a suitable sound dampening material such as indicated at 7 and 8. This material may be in the form of loosely compacted felt, burlap, carpet, plush, felt, sponge rubber or some other material of similar characteristics placed on in single or multiple thickness [sic thicknesses]. It is not perforated but is preferably of "open" characteristics to the extent of permitting penetrability of the sound.

Still further according to '992, through the structure just described, it will be seen that by the provision of openings in the side walls of a sound reproducing device, the directional characteristics of such device are dissipated. There is a tendency for the sound to extend laterally through the openings and dampening covering, the amount of such lateral disposition of the sound being dependent upon the size and shape of such openings and upon the location of the same, together with the thickness and density of the fabric covering.

SUMMARY

In one aspect, one aspect, an acoustic horn includes at least four wall sections, defining a passageway. The passageway includes a throat, for acoustically coupling the interior of the passageway with an acoustic driver and a mouth, through which acoustic energy is radiated from the passageway to the environment. The cross-sectional area of the mouth is at least ten times the cross sectional area of the throat. The wall sections are dimensioned so that at least one wall section (hereinafter a wide wall section) has a dimension at the throat at least ten times a dimension at the throat of a second wall section (hereinafter a narrow wall section). The acoustic horn further includes a pattern of acoustically resistive elements coupling the interior of the passageway with the environment. The pattern extends lengthwise along one of the wall sections. The pattern of acoustically resistive elements may include a pattern of holes. The pattern of acoustically resistive elements may include a slot in one of the wall sections and acoustically resistive material in the slot. The acoustic horn of claim may include two wide wall sections and two narrow wall sections. The pattern of acoustic resistance may be in the first two of the wall sections. The wide wall sections may be free of any acoustic resistances coupling the interior of the passageway with the environment. The narrow wall may sections diverge linearly. The narrow wall sections may diverge non-linearly. At least two of the wall sections may be a unitary structure The pattern of resistive elements may be in a narrow wall section. The pattern of resistive elements may be configured so that the radiation through the pattern of resistive elements is directional in a direction parallel to the wall section. The wide wall section may have a dimension at the throat at least fifteen times the dimension at the throat of the narrow wall section. The acoustic wide wall sections may be outwardly flared.

In another aspect, an acoustic horn includes a passageway. The passageway includes a throat, for acoustically coupling the interior of the passageway with an acoustic driver and a mouth, through which acoustic energy may be radiated from the passageway to the environment. The cross-sectional area of the mouth may be at least ten times the cross sectional area of the throat. The cross-section at the mouth is elongated and may be bounded by a continuous curve defining a geometric figure having a major axis at least ten times a minor axis. The acoustic horn may further include a pattern of acoustically resistive elements coupling the interior of the passageway with the environment. The pattern has a width no greater than the minor axis and extends lengthwise along a curved edge of the passageway. The pattern of acoustically resistive elements may include a pattern of holes. The pattern of acoustically resistive elements may include a slot in one of the wall sections and acoustically resistive material in the slot. The pattern of acoustic resistances and the mouth may be the only acoustic couplings between the passageway with the environment. The pattern of resistive elements may be configured so that the radiation through the pattern of resistive elements may be directional in a direction parallel to the wall section. The major axis at the throat at least fifteen times the minor axis at the throat. The cross section at the mouth may be oval shaped. The cross section at the mouth may be a closed continuous curve includes two semicircles connected by two straight lines.

Other features, objects, and advantages will become apparent from the following detailed description, when read in connection with the following drawing, in which:

DETAILED DESCRIPTION

Figure 1:
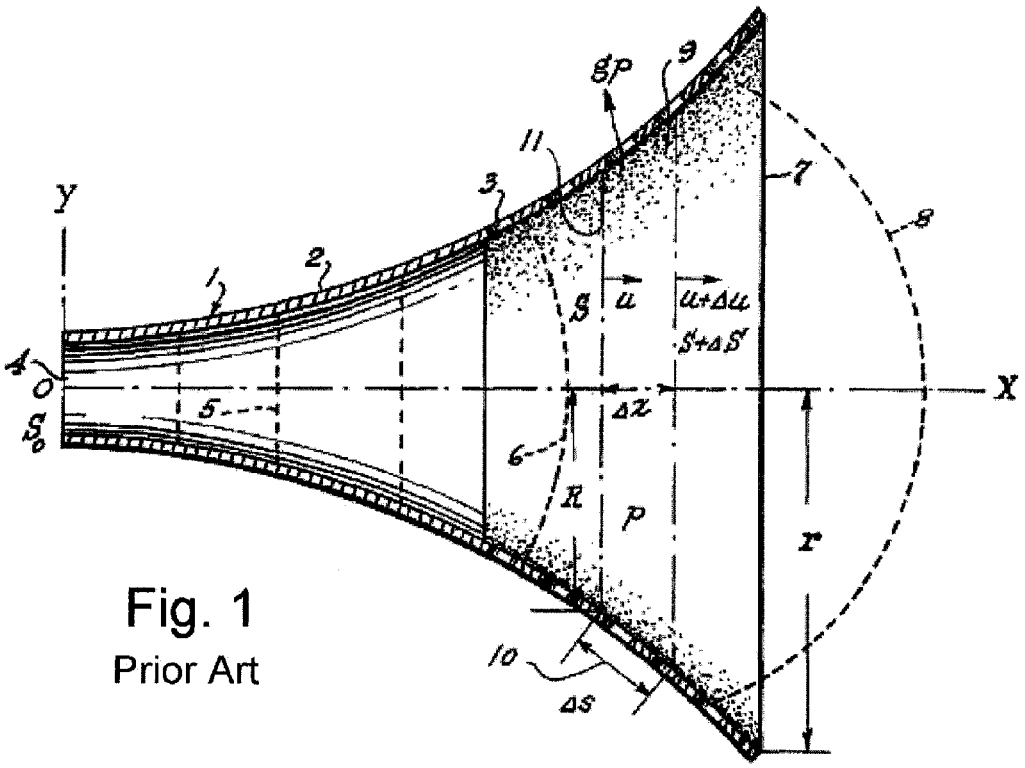
Fig. 1 Prior Art
FIG. 1 is a cross sectional view of a prior art horn of a loudspeaker.
Figure 2:
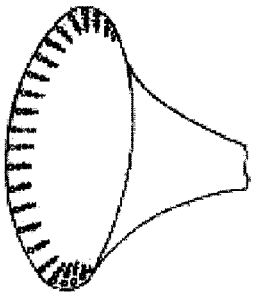
Fig. 2 Prior Art
FIG. 2 is an isometric view of a prior art horn of a loudspeaker.
Figure 3:
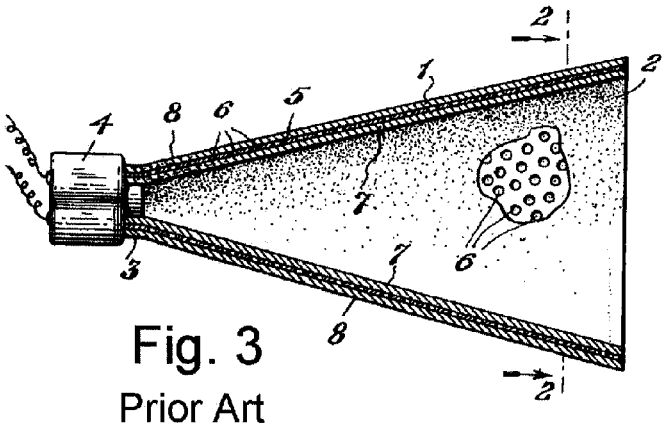
Fig. 3 Prior Art
FIG. 3 is a cross sectional view of a prior art horn of a loudspeaker.
Figure 4A:
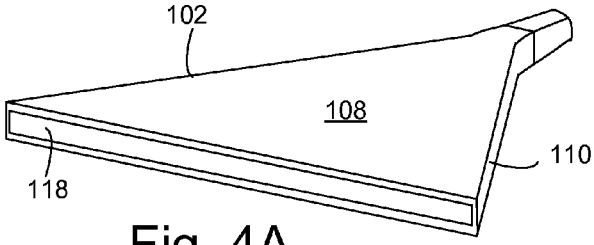
FIGS. 4A and 4B are isometric views of a horns for a horn loudspeaker.
Figure 4B:
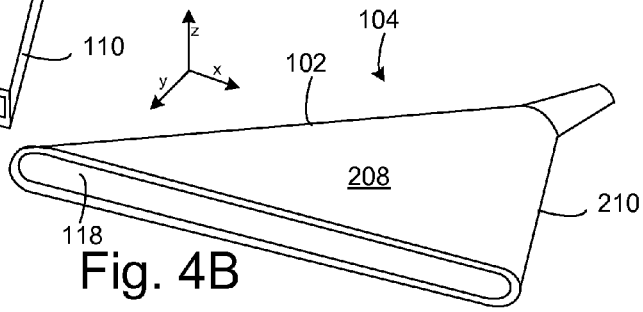
Figure 5:
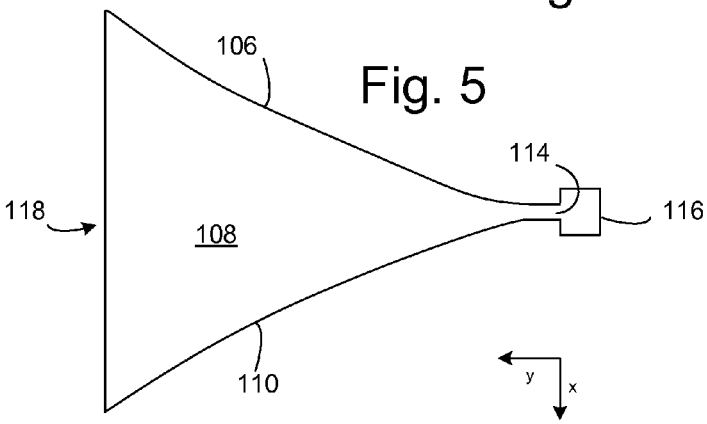
FIGS. 5 and 6 are plan views of a horn loudspeaker.
Figure 6:
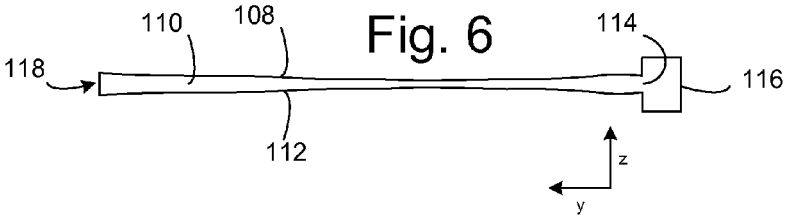

FIGS. 4A and 4B show isometric views of horns 102 of a horn loudspeaker. FIGS. 5 and 6 show, respectively, a top plan view and a side plan view of horn loudspeakers including the horns of FIGS. 4A and 4B. FIGS. 4A-10 also show a Cartesian coordinate system that will be used in this Specification to describe the system. The horn of FIGS. 4A-6 are configured so that the horns have a larger x-dimension (hereinafter x) than z-dimension (hereinafter z). The horns can also be used in orientations other than the orientation shown. FIGS. 4A-7D are not necessarily drawn to scale. Actual absolute and relative dimensions are stated in the Specification.

Referring to FIG. 4A, the horn 102 portion of a loudspeaker is defined by four wall sections 106, 108, 110, and 112 (106 and 112 not visible in this view). The wall sections are configured so that two of the wall sections 106 and 110 diverge from each other in the x-direction so that x increases as a function of the distance in the y-direction from the throat 114 (where the horn 102 is acoustically coupled to an acoustic driver 116) to the mouth 118 (where the horn 102 is acoustically coupled to the environment), so that the cross-sectional area in the x-z plane is substantially larger (for example, 5700 $mm^2$) at the mouth than it is at the throat (for example 361 $mm^2$). The divergence may be in the x-direction only, with the z-dimension constant. Alternatively, or in addition, the z-dimension may vary along the axis of the horn but varies less than in the x-direction, so that at the mouth, x is much larger than z (for example $x \geq 10z$). In one implementation, aspect ratio $$\frac{x}{z} \text{ is } \frac{300}{19}$$

or about 15.8. Wall sections 106, 110 may diverge linearly (so that, for example, in FIG. 5, the wall sections 106 and 110 would appear as straight lines or may diverge according to some nonlinear curve, such as an exponential curve (so that, for example, in FIG. 5, the wall sections 106 and 110 would be curved).

In FIG. 4B, the horn is configured so that the horn is bounded by a continuous wall. Similar to the horn of FIG. 4A, the horn diverges in the x-direction so that the cross sectional area at the mouth is significantly larger than the cross sectional area at the throat. In the z-direction, the horn diverges less than in the x-direction, so that at the mouth 118, x is much greater than z (for example $x \geq 10z$). The horn of FIG. 4B has two curved edges 206 and 210 (only 210 visible in this view) and two wall areas 208 and 212 (only 208 visible in this view) that are planar or have a curvature that is significantly less than edges 206 and 210.

FIGS. 7A-7D show cross sections in the x-y plane at the mouth and at various intermediate points of implementations of the horn of FIGS. 4A-6. FIGS. 7A-7D are not drawn to scale. Actual and relative dimensions are described in the Specification. The horns of FIGS. 7A and 7B have substantially rectangular cross sections. Near the throat of the horn, the dimension x may be only slightly larger or even equal to the dimension z; however at the mouth 118 of the horn, x is much larger than z (for example $x \geq 10z$). In one embodiment, the maximum x-dimension is 300 mm and the maximum z-dimension is 19 mm, so that the aspect ratio $$\frac{x}{z} = 15.8.$$

Figure 7A:
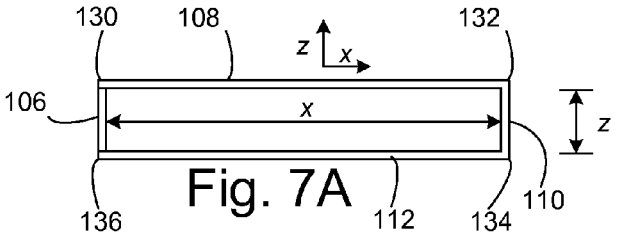
FIGS. 7A-7D are cross sectional views at the mouth of a horn for a loudspeaker.
Figure 7B:
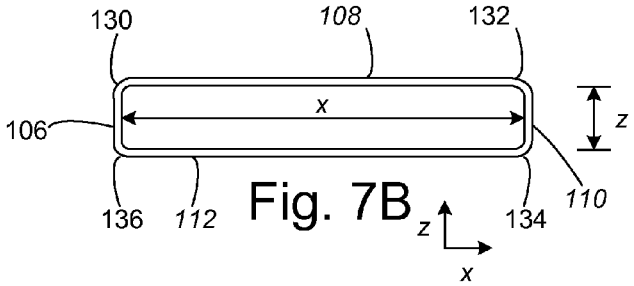

Wall sections 106, 108, 110, and 112 could be planar or non-planar, curved surfaces. The wall sections 106, 108, 110, and 112 can be separate sections, with edges of the separate sections joined to be form the horn so that in cross section in the x-z plane, the horn appears as a rectangle as shown in FIG. 7A. In the implementations of FIGS. 7A and 7B, the wall sections are defined by their spatial orientation relative to the other wall sections, not by whether they are separate structures. The transitions 130, 132, 134, and 136 between the wall sections may be right angles, as in FIG. 7A or may be curved, as in FIG. 7B. Different combinations of unitary and separate structures could be used; for example, wall sections 106 and 108 could be a unitary structure and wall sections 110 and 112 could be a second unitary structure, or wall sections 106, 108, and 110 could be a unitary structure.

Figure 7C:
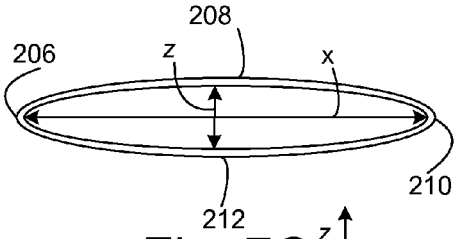
Figure 7D:
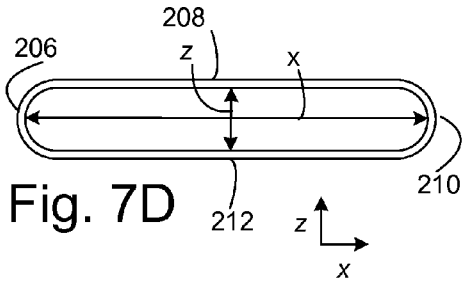

FIGS. 7C and 7D show horns with cross sections that are elongated structures bounded by a continuous curve, such as an ellipse (FIG. 7C) or "racetrack" (that is, two semicircles connected by substantially straight lines as in FIGS. 4B and 7D) with a major axis (the longest diameter) x slightly larger, or equal to, minor axis z (the shortest diameter) at the throat 114 but with a major axis (the longest diameter) x much larger (for example 10x) the minor axis z (the shortest diameter) at the mouth. The horn has an aspect ratio (that is, the major axis relative to the minor axis) at the mouth of 10 or greater. In one example, the aspect ratio $$\frac{x}{z} \text{ is } \frac{300}{19}$$

or 15.8.

A horn according to FIGS. 4-6 has different radiation patterns in different orthogonal planes. For the purposes of characterizing the radiation patterns, the radiation is normalized, and the radiation is expressed in terms of −dB relative to the maximum radiation in any direction.

Radiation patterns can be characterized as "more directional", "less directional", "highly directional" or "non-directional" or "omnidirectional" in a number of ways. For example a −6 dB angle is the angle at which the radiation is within −6 dB relative to the direction of maximum radiation. A "more directional" radiation pattern would have a smaller −6 dB angle than a "less directional" radiation pattern. A "highly directional" radiation pattern would have a small (for example less than about 45 degrees) −6 dB angle, while a "non-directional" radiation pattern would have a large (for example greater than 180 degrees) −6 dB angle and in an "omnidirectional" radiation pattern, the radiation would be within about −6 dB in all directions. Radiation patterns may also be characterized by a −24 dB angle, that is, the angle at which the radiation is within −24 dB relative to the direction of maximum radiation. "More directional" would have a smaller −24 dB angle than a "less directional" radiation pattern, and a "highly directional" radiation pattern would have a small −24 dB angle, for example 60 degrees, while a "non-directional" radiation pattern would not have a −24 dB angle.

Acoustic devices generally become more directional at higher frequencies (shorter wavelengths). So in comparing the radiation pattern of one acoustic device to another, it is typical to provide a radiation pattern for each device at several frequencies and compare the radiation patterns at each of the several frequencies.

The directivity of radiation patterns may also be characterized in terms of the minimum radiation in any direction. For example the minimum radiation in any direction in a "more directional" radiation pattern would have less radiation than in a "less directional" radiation pattern; that is, if the radiation is expressed in terms of −n dB, the absolute value of n is larger for a more directional radiation pattern than for a less directional radiation pattern. In a highly directional radiation pattern, the absolute value of n would be greater than about 24, while in a non-directional radiation pattern, the absolute value of n would typically be less than about 12.

The directivity pattern may also be characterized by the presence or absence of nulls. Nulls are local radiation minima in which the radiation is less than the maximum radiation by a specified amount, for example, directions in which the absolute value of n (in the expression −n dB) is 20 or greater.

Figure 8:
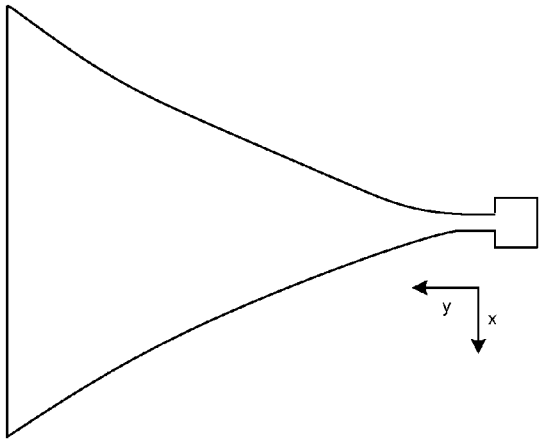
FIGS. 8 and 9 are polar plots of the radiation patterns of a horn loudspeaker in different planes.
Figure 8:
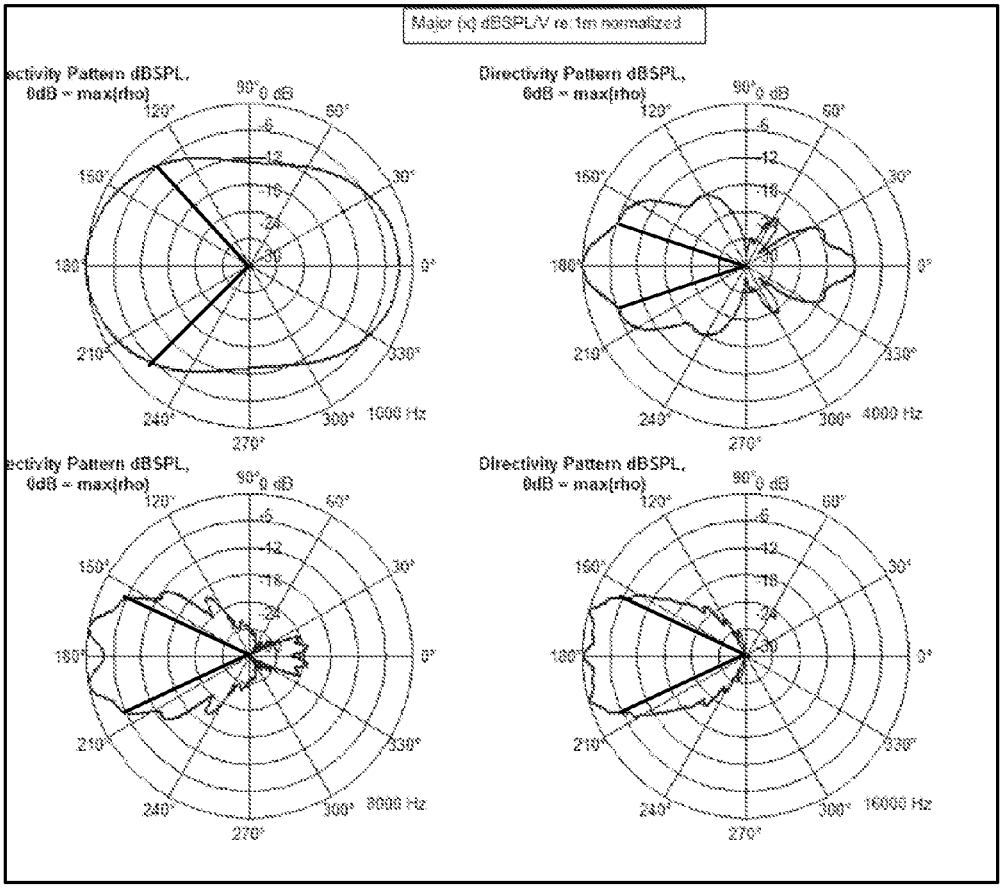

For example FIG. 8 shows the directivity pattern in the x-y plane. In the x-y plane, the horn according to FIGS. 4-6 exhibits typical horn behavior. At 1 kHz, the radiation pattern has a −6 dB angle of about 90 degrees, a minimum radiation of about −12 dB relative to the radiation in the direction the horn faces, and radiation of about −3 dB in a direction opposite to the direction the horn faces. At 4 kHz, the radiation pattern has a −6 dB angle of about 40 degrees, nulls (radiation of less than −30 dB) approximately orthogonal to the direction the horn faces, and radiation of about −12 dB in a direction opposite to the direction the horn faces. At 8 kHz, the radiation pattern has a −6 dB angle of about 50 degrees, two nulls and radiation of about −18 dB in a direction opposite to the direction the horn faces. At 16 kHz, the radiation pattern is highly directional, with a −6 dB angle of about 50 degrees, and a −24 dB angle of about 120 degrees.

Figure 9:
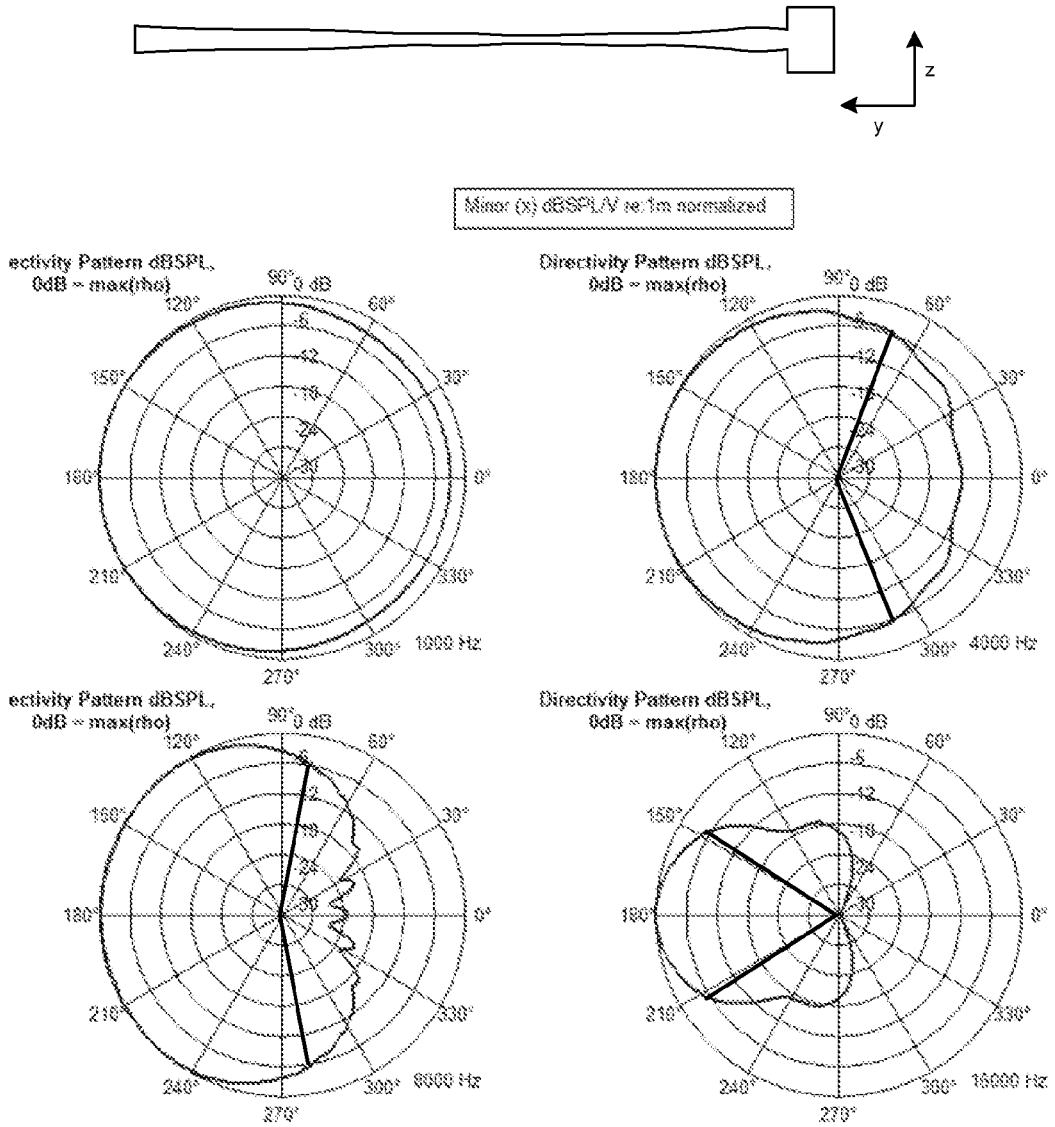

The radiation pattern in the x-z plane of a horn according to FIGS. 4-6 is shown in FIG. 9. At 1 kHz, the radiation pattern is substantially omnidirectional, with the radiation varying less than about −3 dB in any direction. At 4 kHz, the radiation pattern has a −6 dB angle of about 220 degrees, with no nulls, and radiation of about −12 dB in a direction opposite to the direction the horn faces. At 8 kHz the radiation pattern has a −6 dB angle of about 200 degrees, with radiation of about −24 dB in the direction opposite to the direction the horn faces. At 16 kHz, the radiation pattern has a −6 dB angle of about 65 degrees and a −30 dB angle of about 240 degrees.

Compared on a frequency by frequency basis, it can be seen that the radiation patterns of FIG. 8 are more directional than the radiation patterns of FIG. 9, and that at low frequencies (less than 4 kHz) the radiation patterns of FIG. 9 are omnidirectional or close to omnidirectional, while at similar frequencies, the radiation patterns of FIG. 8 are not close to omnidirectional. This directivity pattern can be advantageous in some circumstances. For example, a radiation pattern that is directional outwardly in the x-y plane, so that more acoustic energy reaches a listener after being reflected off walls than reaches the listener directly can provide a more spacious acoustic image than if most of the energy reaches the listener directly. However if the radiation pattern is omnidirectional in the y-z plane, the acoustic image would be more uniform for listeners that are seated or standing.

As compared to horns which diverge more uniformly, for example horns that have a square or circular cross section at the mouth, the horn of FIGS. 4-6 has a greater impedance mismatch at the mouth of the horn, so the horn according to FIGS. 4-6 may be more prone to reflections and resonances than horns which diverge more uniformly. A method of damping the resonances is shown in FIGS. 10A-10D. FIGS. 10A-10D are not drawn to scale. A pattern of acoustically resistive elements, acoustically coupling the interior of the horn with the environment is positioned so that the pattern extends lengthwise along one or both of the narrow wall sections 106 and 110. One implementation of the pattern of acoustic resistances (FIG. 10A) is a plurality of holes that are sufficiently small to provide acoustic resistance. Another implementation of the pattern of acoustic resistances (FIG. 10B) is a slot extending lengthwise in one of the narrow wall sections 106 and 110, with metal mesh or fabric that provides, for example 140-920 and preferably 260-420 rayls of acoustic resistance. In one implementation, the pattern of acoustic resistances is exclusively in the narrow wall sections 106 and 110; that is, the wide wall sections 108 and 112 are unbroken surfaces. Generally, the slot should occupy about 15% of the area of the narrow wall sections 106 and 110, and preferably about 22-25%. Leakage through the acoustically resistive material 124 dampens resonances that may develop as a result of impedance mismatches at the mouth of the horn.

Figure 10A:
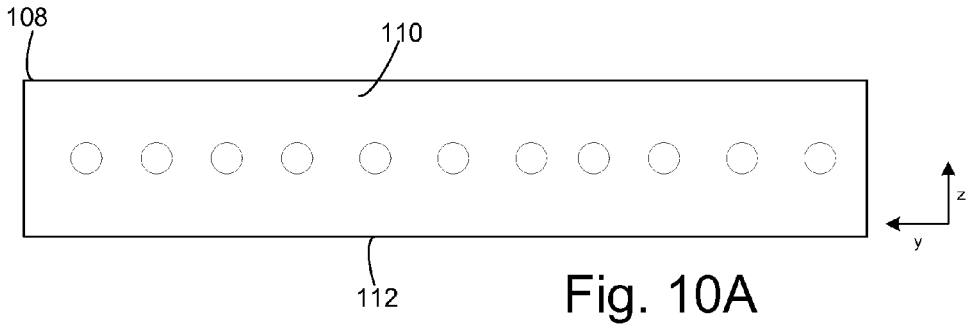
FIGS. 10A and 10B are plan views of a portion of a horn of a horn loudspeaker.
Figure 10B:
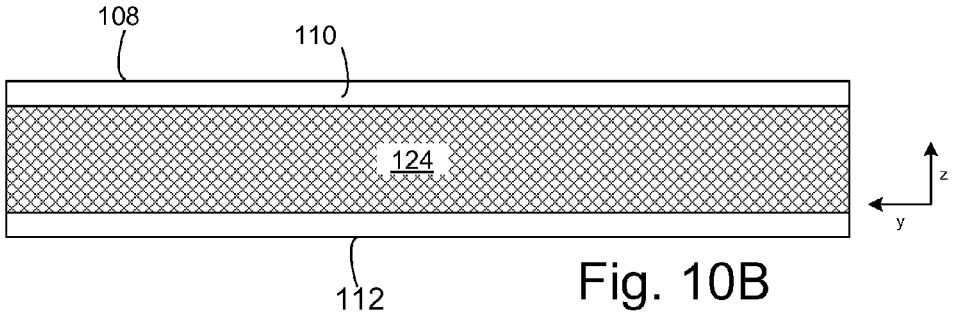
Figure 10C:
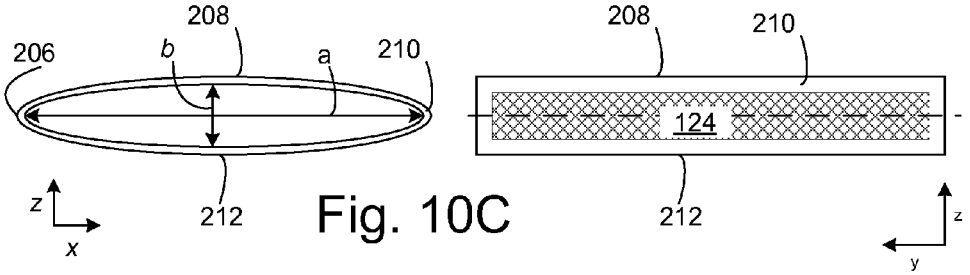
FIGS. 10C and 10D are cross sectional views and partial plan views of a horn of a horn loudspeaker.
Figure 10D:
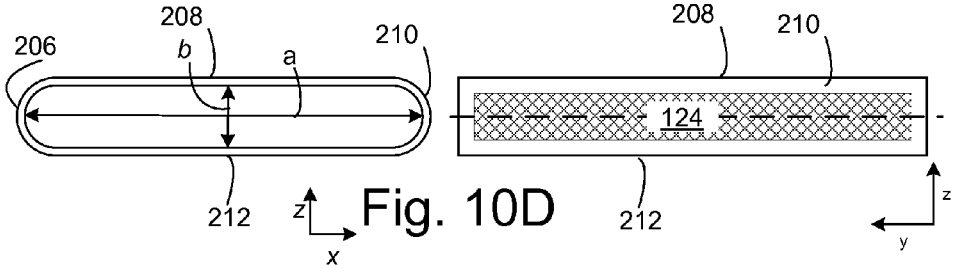

FIGS. 10C and 10D are implementations that do not have rectangular cross sections at the mouth of the horn, but rather have cross-sections bounded by continuous curves, such as an ellipse (FIG. 10C, similar to the horn of FIG. 7C) or a racetrack (FIG. 10D, similar to the horn of FIGS. 4B and 7D). The implementations of FIGS. 7C and 7D have elongated cross sections, with the pattern of acoustic resistances at the curved edges 106, 110. Similar to the implementations of FIGS. 10A and 10B, the horns of FIGS. 10C and 10D have pattern of acoustically resistive elements, acoustically coupling the interior of the horn with the environment, positioned so that the pattern extends lengthwise along one or both of the narrow curved edges 106 and 110 of the horn. In cross section, the patterns of acoustic resistances, for example a slot with acoustically resistive material 124 is at the elongated ends of the cross sections. Generally, the slot should occupy a wall area approximately similar to the implementations of FIGS. 10A and 10B. The acoustically resistive material 124 and the mouth of the horn may be the only acoustic coupling between the interior of the horn and the environment; in other words, there are no openings in wall areas 208 and 212.

Figure 11:
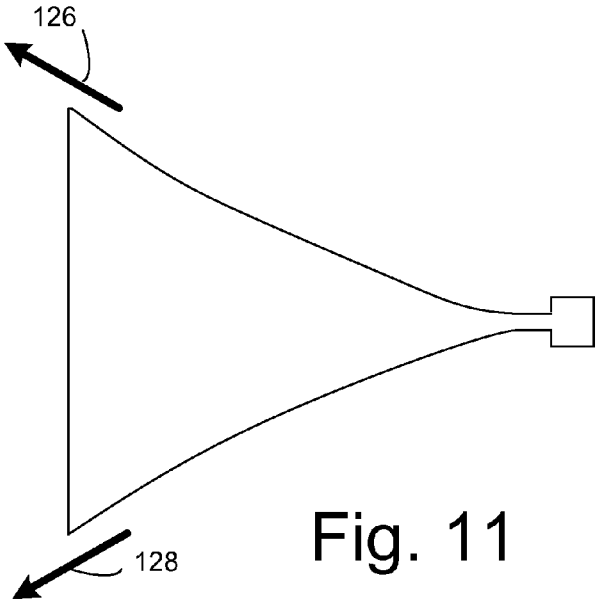
FIG. 11 shows two plan views of a horn type loudspeaker illustrating an aspect of the radiation pattern of a horn loudspeaker.

FIG. 11 illustrates an additional advantage of the configuration of FIG. 10. Pressure waves that leak through the acoustically resistive material 124 interfere constructively in the direction of propagation of the pressure wave in the horn and interfere destructively in other directions. Therefore, the radiation through the acoustically resistive material 124 is directional in a direction substantially parallel to the surface of the wall sections 106 and 110, as illustrated by arrows 126 and 128. In this respect, the resistive material 124 in wall sections 106 and 110 acts in a manner similar to the resistive material along the pipe of U.S. patent application Ser. No. 12/114,261, published as U.S. Published Pat. App. 2009/0274329, now U.S. Pat. No. 8,351,630. In this way the radiation through the resistive material 124 is directional in the substantially the same direction as the horn, so that the radiation through the resistive material actually supplements that radiation through the mouth of the horn. Placing the pattern of acoustic resistance in the narrow wall sections 106 and 110 of previous figures, or the narrow edges 206 and 210 of previous figures, causes the directional effect illustrated in FIG. 11 to accentuate the directional effect illustrated in FIGS. 8 and 9.

Figure 12A:
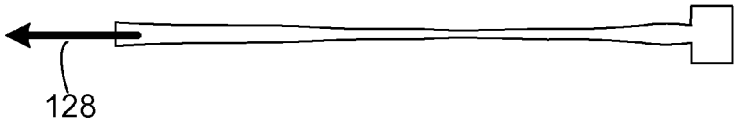
FIGS. 12A and 12B are axial cross sectional views of the mouth of a horn for a horn loudspeaker.
Figure 12A:
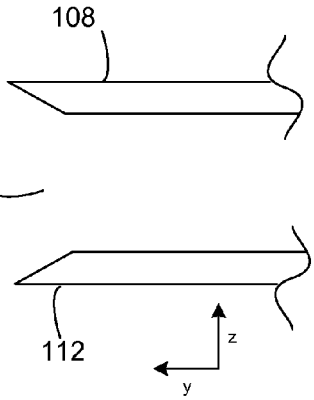
Figure 12B:
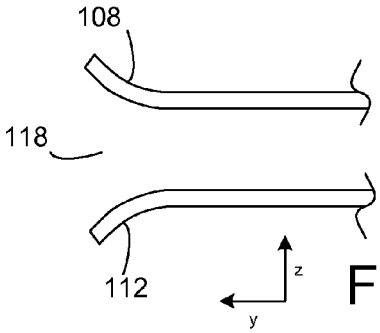

As stated previously, the z-dimension may vary along the axis of the horn. Varying the z-dimension may provide some benefit (in addition to the benefit provided by the pattern of resistance) in reducing resonances due to impedance mismatch at the horn mouth. Even a slight variance, for example by chamfering, beveling, or rounding the horn wall as in FIG. 12A provides some benefit. Alternatively, wall sections 108 and 112 can be flared slightly at the mouth. The slight flare over the relatively short distance does not significantly affect the directional characteristics of the horn, but provides some damping of resonances due to impedance mismatches.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. An acoustic horn, comprising:

at least four wall sections, defining a passageway, the passageway comprising a throat, for acoustically coupling the interior of the passageway with an acoustic driver and a mouth, through which acoustic energy is radiated from the passageway to the environment;

wherein the cross-sectional area of the mouth is at least ten times the cross sectional area of the throat;

wherein the wall sections are dimensioned so that at least one wall section which is a wide wall section; has a dimension at the mouth at least ten times a dimension at the mouth of a second wall section which is a narrow wall section;

the acoustic horn further comprising a pattern of acoustically resistive elements coupling the interior of the passageway with the environment, the pattern extending lengthwise along at least one of the narrow wall sections.

2. The acoustic horn of claim 1, wherein the pattern of acoustically resistive elements comprises a pattern of holes.

3. The acoustic horn of claim 1, wherein the pattern of acoustically resistive elements comprises a slot in one of the wall narrow sections and acoustically resistive material in the slot.

4. The acoustic horn of claim 1, wherein the wide wall sections are free of any acoustic resistances coupling the interior of the passageway with the environment.

5. The acoustic horn of claim 1, wherein the narrow wall sections diverge linearly.

6. The acoustic horn of claim 1, wherein the narrow wall sections diverge non-linearly.

7. The acoustic horn of claim 1, wherein at least two of the wall sections are a unitary structure.

8. The acoustic horn of claim 1, wherein the pattern of resistive elements is configured so that the radiation through the pattern of resistive elements is directional in a direction parallel to the wall narrow section.

9. The acoustic horn of claim 1, wherein the wide wall section has a dimension at the mouth at least 15 times the dimension at the mouth of the narrow wall section.

10. The acoustic horn on claim 1, wherein the wide wall sections are outwardly flared.

11. An acoustic horn, comprising:

a passageway, the passageway comprising a throat, for acoustically coupling the interior of the passageway with an acoustic driver and a mouth, through which acoustic energy is radiated from the passageway to the environment;

wherein the cross-sectional area of the mouth is at least ten times the cross sectional area of the throat;

wherein the cross-section at the mouth is elongated and is bounded by a continuous curve defining a geometric figure having a major axis at least ten times a minor axis;

the acoustic horn further comprising a pattern of acoustically resistive elements coupling the interior of the passageway with the environment, the pattern having a width no greater than the minor axis and extending lengthwise along a curved edge of the passageway.

12. The acoustic horn of claim 11, wherein the pattern of acoustically resistive elements comprises a pattern of holes.

13. The acoustic horn of claim 11, wherein the pattern of acoustically resistive elements comprises a slot acoustically resistive material in the slot.

14. The acoustic horn of claim 11, wherein the pattern of acoustic resistances and the mouth are the only acoustic couplings between the passageway with the environment.

15. The acoustic horn of claim 11, wherein major axis at the mouth at least 15 times the minor axis at the mouth.

16. The acoustic horn of claim 11, wherein the cross section at the mouth is oval shaped.

17. The acoustic horn of claim 11, wherein the cross section at the mouth is a closed continuous curve comprising two semicircles connected by two straight lines.

* * * * *